US009138796B2

(12) United States Patent
Deeley et al.

(10) Patent No.: US 9,138,796 B2
(45) Date of Patent: Sep. 22, 2015

(54) SHEET MATERIAL

(75) Inventors: Geoffrey Thomas Deeley, Belbroughton (GB); Roy Humpage, West Midlands (GB); Michael Castellucci, West Midlands (GB)

(73) Assignee: Hadley Industries Overseas Holdings Limited, West Midlands (GB)

( * ) Notice: Subject to any disclaimer, the term of this patent is extended or adjusted under 35 U.S.C. 154(b) by 0 days.

(21) Appl. No.: 13/175,208

(22) Filed: Jul. 1, 2011

(65) Prior Publication Data

US 2012/0000264 A1 Jan. 5, 2012

Related U.S. Application Data

(62) Division of application No. 13/087,014, filed on Apr. 14, 2011, now Pat. No. 7,992,418, which is a division of application No. 11/962,564, filed on Dec. 21, 2007, now Pat. No. 7,947,380.

(30) Foreign Application Priority Data

Nov. 13, 2007 (GB) ..... 0722263.1

(51) Int. Cl.

| | |
|---|---|
| ***B21D 13/10*** | (2006.01) |
| ***B21B 27/00*** | (2006.01) |
| ***B21D 13/04*** | (2006.01) |
| ***E04C 2/32*** | (2006.01) |

(52) U.S. Cl.

CPC ..... *B21D 13/10* (2013.01); *B21B 27/005* (2013.01); *B21D 13/04* (2013.01); *E04C 2/326* (2013.01); *Y10T 428/12382* (2015.01); *Y10T 428/12417* (2015.01); *Y10T 428/2457* (2015.01)

(58) Field of Classification Search

CPC ..... B21B 27/005; B21B 27/021; B21B 2027/021; B31F 1/07; B21D 13/04; B21D 13/10

USPC ..... 72/190, 191, 196, 197, 199, 205, 226, 72/234, 252.5, 186, 375, 379.6; 428/180, 428/182, 183, 153, 154; 101/5, 6, 22, 23; 264/280, 282

See application file for complete search history.

(56) References Cited

U.S. PATENT DOCUMENTS

| | | | |
|---|---|---|---|
| 7,198 | A | 3/1850 | Ransom |
| 662,567 | A | 11/1900 | Von Lipowska et al. |
| 1,499,985 | A | 7/1924 | Kirsch |

(Continued)

FOREIGN PATENT DOCUMENTS

| | | |
|---|---|---|
| BE | 638854 | 10/1963 |
| CH | 486281 | 4/1970 |

(Continued)

*Primary Examiner* — Edward Tolan
(74) *Attorney, Agent, or Firm* — Caesar Rivise, PC

(57) ABSTRACT

A sheet of cold rolled material having on both of its surfaces rows of projections and rows of depressions, the projections on one surface corresponding with the depressions on the other surface, the relative positions of the projections and depressions being such that lines drawn on a surface of the sheet between adjacent rows of projections are non-rectilinear, the sheet having a base gauge G, wherein each projection has a substantially continuous region of peak plastic strain at, toward or about its apex and/or is thinned by no more than 25% of its base gauge G. Methods of forming the sheet material and tools for forming the sheet material are disclosed.

13 Claims, 9 Drawing Sheets

(56) References Cited

U.S. PATENT DOCUMENTS

| | | | | | |
|---|---|---|---|---|---|
| 1,616,968 | A | | 2/1927 | Hall | |
| 2,156,934 | A | * | 5/1939 | Barrett | 228/17.5 |
| 2,378,661 | A | | 6/1945 | Salzer | |
| 2,441,476 | A | | 5/1948 | Ewald | |
| 2,481,046 | A | | 9/1949 | Scurlock | |
| 2,986,193 | A | | 5/1961 | Howell | |
| 3,013,641 | A | | 12/1961 | Compton | |
| 3,137,922 | A | | 6/1964 | Schumacher | |
| 3,150,707 | A | * | 9/1964 | Howell | 72/177 |
| 3,217,845 | A | | 11/1965 | Reynolds et al. | |
| 3,273,976 | A | | 9/1966 | Wogerbauer | |
| 3,414,459 | A | * | 12/1968 | Wells | 428/180 |
| 3,653,246 | A | * | 4/1972 | Bock et al. | 72/198 |
| 3,706,218 | A | * | 12/1972 | Elmer | 72/375 |
| 3,777,532 | A | * | 12/1973 | Noe | 72/205 |
| 3,956,543 | A | | 5/1976 | Stangeland | |
| 3,968,603 | A | | 7/1976 | Merson | |
| 3,992,835 | A | | 11/1976 | Saveker | |
| 4,025,996 | A | | 5/1977 | Saveker | |
| 4,027,517 | A | | 6/1977 | Bodnar | |
| 4,068,366 | A | * | 1/1978 | Hillesheim | 29/527.4 |
| 4,143,499 | A | | 3/1979 | Naslund | |
| 4,179,912 | A | | 12/1979 | Culina et al. | |
| 4,503,696 | A | * | 3/1985 | Roeder | 72/197 |
| 4,597,277 | A | * | 7/1986 | Esmieu | 72/182 |
| 4,781,050 | A | * | 11/1988 | Winter et al. | 72/205 |
| 4,962,622 | A | | 10/1990 | Albrecht et al. | |
| 4,978,583 | A | * | 12/1990 | Wakui et al. | 428/600 |
| 5,036,758 | A | * | 8/1991 | Kobayashi et al. | 101/28 |
| 5,056,348 | A | | 10/1991 | Albrecht et al. | |
| 5,354,581 | A | * | 10/1994 | Laube | 427/299 |
| 5,375,446 | A | * | 12/1994 | Hein | 72/186 |
| 5,508,119 | A | * | 4/1996 | Sheu et al. | 428/687 |
| 5,509,288 | A | * | 4/1996 | Ohno et al. | 72/186 |
| 5,595,082 | A | | 1/1997 | Gandara | |
| 5,600,890 | A | * | 2/1997 | Leitner et al. | 30/223 |
| 5,689,990 | A | | 11/1997 | Deeley | |
| 5,692,347 | A | | 12/1997 | Hulek | |
| 6,183,879 | B1 | | 2/2001 | Deeley | |
| 6,263,715 | B1 | | 7/2001 | Blazley | |
| 6,887,349 | B2 | * | 5/2005 | Ruthven et al. | 162/114 |
| 7,423,003 | B2 | * | 9/2008 | Volpenhein et al. | 510/438 |
| 7,435,313 | B2 | * | 10/2008 | Boatman et al. | 162/117 |
| 7,597,777 | B2 | * | 10/2009 | Wilke, II | 162/117 |
| 7,942,995 | B2 | * | 5/2011 | Evans et al. | 156/209 |
| 7,947,380 | B2 | | 5/2011 | Deeley et al. | |
| 7,992,418 | B1 | * | 8/2011 | Deeley et al. | 72/252.5 |
| 2002/0148269 | A1 | * | 10/2002 | Ruck et al. | 72/197 |
| 2002/0148270 | A1 | | 10/2002 | Easterbrook | |
| 2003/0021953 | A1 | * | 1/2003 | Graff | 428/153 |
| 2005/0230033 | A1 | | 10/2005 | Faehrrolfes et al. | |
| 2005/0279470 | A1 | * | 12/2005 | Redd et al. | 162/109 |
| 2009/0202856 | A1 | | 8/2009 | Hiraoka et al. | |

FOREIGN PATENT DOCUMENTS

| | | | | | |
|---|---|---|---|---|---|
| DE | 1222881 | | | 8/1966 | |
| DE | 2924905 | A1 | * | 1/1981 | B21D 13/10 |
| EP | 0020829 | | | 1/1981 | |
| EP | 0144870 | | | 6/1985 | |
| EP | 0279798 | | | 8/1988 | |
| EP | 0674551 | | | 10/1995 | |
| EP | 0891234 | | | 1/1999 | |
| EP | 1772206 | | | 4/2007 | |
| FI | 20055541 | | | 11/2005 | |
| GB | 1305489 | | | 1/1973 | |
| GB | 1359993 | | | 7/1974 | |
| GB | 1456530 | | | 11/1976 | |
| GB | 2063735 | | | 6/1981 | |
| GB | 2095595 | | | 10/1982 | |
| GB | 2279596 | | | 1/1995 | |
| GB | 2302106 | | | 1/1997 | |
| GB | 2311949 | | | 10/1997 | |
| GB | 2341195 | | | 3/2000 | |
| GB | 2350377 | | | 11/2000 | |
| GB | 2385816 | | | 9/2003 | |
| JP | 1977-43312 | | | 3/1977 | |
| JP | 11138218 | | | 5/1999 | |
| JP | 2002-38944 | A | | 2/2002 | |
| JP | 2002285237 | | | 10/2002 | |
| JP | 2003-245725 | A | | 9/2003 | |
| RU | 2220803 | | | 1/2004 | |
| RU | 2254194 | | | 6/2005 | |
| WO | 82/03347 | | | 10/1982 | |
| WO | 94/12294 | | | 6/1994 | |
| WO | WO94/25195 | | | 11/1994 | |
| WO | 97/35674 | | | 10/1997 | |
| WO | 03/056111 | | | 7/2003 | |
| WO | 2007/046116 | | | 4/2007 | |
| WO | 2007/105251 | A1 | * | 9/2007 | B31F 1/07 |

* cited by examiner

SHEET MATERIAL

CROSS REFERENCE TO RELATED APPLICATIONS

The present application is a divisional application and claims the benefit under 35 U.S.C. §121 of application Ser. No. 13/087,014, filed on Apr. 14, 2011 entitled SHEET MATERIAL, which is a divisional application and claims the benefit under 35 U.S.C. §121 of application Ser. No. 11/962,564, filed on Dec. 21, 2007 entitled SHEET MATERIAL, which in turn claims the benefit under 35 U.S.C. §119(a) of Great Britain Application No. GB0722263.1 filed on Nov. 13, 2007 also entitled SHEET MATERIAL.

The present invention relates generally to sheet material and more specifically to sheet material having projections on its surfaces.

As referred to herein, sheet material of the kind specified refers to sheet material having on both of its faces a plurality of rows of projections, each projection having been formed by deforming the sheet material locally to leave a corresponding depression at the opposite face of the material. This deformation is effected by a forming tool and results in both plastic strain hardening and in an increase of the effective thickness thereof. Sheet material of the kind specified is stiffer than the plain sheet material from which it is formed and the mass of material required for a particular duty can be reduced by using sheet material of the kind specified in place of plain sheet material.

The magnitude and distribution of plastic strain exerted on the sheet material depends on a number of factors including, inter alia, the depth of penetration of the forming portions of the tool and the geometry of the forming portions.

An example of sheet material of the kind specified is disclosed in EP0674551, which is owned by the current applicant, wherein the sheet material is provided with the relative positions of the projections and depressions such that lines drawn on a surface of the material between adjacent rows of projections and depressions are non-linear. The projections are formed by forming tools having teeth with four flanks, wherein each flank faces a direction between the axial and circumferential directions of the rolls.

A further factor which affects the magnitude and distribution of plastic strain in such an arrangement is the layout or concentration of teeth in the forming tool.

According to a first aspect of the invention there is provided sheet material, for example a sheet of cold rolled material, having on both of its surfaces rows of projections and rows of depressions, the projections on one surface corresponding with the depressions on the other surface opposite each projection, the relative positions of the projections and depressions being such that lines drawn on a surface of the sheet between adjacent rows of projections are non-rectilinear, the sheet having a base gauge G, wherein each projection has a substantially continuous region of peak plastic strain at, toward or about its apex and/or is thinned by no more than 25% of its base gauge G.

According to a second aspect of the invention there is provided sheet material, for example a sheet of cold rolled material, having on both of its surfaces a plurality of projections, a corresponding depression being present on the surface opposite each projection, the projections and depressions being arranged in rows of alternating projections and depressions, wherein the peak of each projection is rounded and featureless and/or the base of each depression may comprise two or more different radii of curvature.

According to a third aspect of the invention there is provided sheet material, for example a sheet of cold rolled material, having on both of its surfaces a plurality of projections, a corresponding depression being present on the surface opposite each projection, the projections and depressions being arranged in rows of alternating projections and depressions, wherein the peak of each projection is rounded and featureless and free of pinched regions.

The projections and/or depressions are preferably arranged in rectilinear and/or helical rows. The base of each depression may comprise a first radius $dr_1$, for example in a first direction. The depressions may comprise a second radius $dr_2$, for example in a second and/or longitudinal and/or rolling direction with respect to a length of the sheet material. The first direction may be different from the second direction, for example at 45 degrees therefrom. The depressions may further comprise a third radius $dr_3$, for example in a third direction orthogonal to the first direction. The depressions may further comprise a fourth radius $dr_4$, for example in a fourth direction orthogonal to the second direction. The first and third radii $dr_1$ and $dr_3$ may be equal, with the second radius $dr_2$ and/or $dr_4$ being different therefrom, for example less therethan, or the same thereas.

The pitch P between adjacent depressions or between adjacent projections in each row may be at least 2.5, say 3, times the radius of curvature along the first radius $dr_1$. Additionally or alternatively, the pitch P is preferably between 2.5 and 3.9, for example about 3.3, say 3.32, times the radius of curvature along the first radius $dr_1$.

The sheet material may comprise an amplitude A. The height of projections which is sufficient to ensure that lines drawn on a surface of the material between adjacent rows of projections and depressions are not rectilinear depends upon the pitch of the projections and the pitch of the depressions in the rows.

As viewed in any cross-section in a plane which is generally perpendicular to the sheet material, the amplitude A is preferably substantially greater than the base gauge G of the material. In all such cross sections, sheet material in accordance with the invention is preferably undulatory and there is more preferably no place where the material can be cut along a straight line and the resulting cross section of the material will be rectilinear.

The amplitude A is preferably between 1.5 to 4, say 2 and 3, times the base gauge G. The base gauge G is preferably between 0.2 mm and 3.0 mm, for example 0.7 mm or 1.5 mm.

The plastic strain of the material is preferably 0.05 or more. The proportion of sheet material which is subjected to significant plastic strain, that is to say plastically strained to a value of 0.05 or more, is preferably at least 65% and more preferably over 80%, for example 90% to 100%.

The sheet material may comprise steel, for example, mild steel and may be galvanised. Alternatively, the sheet material may comprise any other material capable of strain hardening and/or plastic deformation.

The sheet material may comprise a profile or shaped cross-section such as a channel section or the like for use as a, or as part of a, partition or channel stud. The projections may be formed over all or part of the shaped section.

According to a fourth aspect of the invention, there is provided an apparatus for cold forming sheet material, the apparatus comprising a pair of opposed tools having rows of teeth on their outer surface and being movable relative to one another, the geometry and position of the teeth and the spacing of the tools being such that the teeth on one tool extend, in use, into gaps between the teeth on the other tool with a minimum clearance between adjacent teeth which is at least equal to the base gauge G of the material to be passed through the apparatus, each tooth comprising a rounded sheet engaging surface free of sharp corners.

Preferably, there is also a minimum clearance, in use, between the peak of each tooth on the one tool and the root surface of the other tool, for example to ensure material to be formed is not pinched therebetween.

The apparatus may further comprise shaping means for shaping the sheet material. The shaping means may comprise a further pair of rollers and may be arranged to shape the formed sheet material, for example into a channel section.

According to a fifth aspect of the invention, there is provided a pair of tools for cold forming sheet material, each tool having a first dimension and a second dimension orthogonal to the first, each tool having a plurality of rows of teeth extending along the first dimension, each tooth having a rounded sheet engaging surface free of sharp corners, the tools being mounted or mountable so that each row of teeth on one tool are in register with spaces between adjacent rows of teeth on the other tool such that each tooth from one tool is equidistantly spaced from each adjacent tooth from the other tool.

According to a sixth aspect of the invention, there is provided a tool for cold forming sheet material, the tool comprising rows of teeth on its outer surface, wherein each tooth has a rounded sheet engaging surface with a radius of curvature R, the pitch P between adjacent teeth in a row being between 2.5 and 3.9 times the radius of curvature R.

Preferably, the pitch P is between 3 and 3.5, for example 3.32, times the radius of curvature R.

The radius of curvature R is preferably at least equal to the base gauge G of a sheet material to be formed and more preferably at least 1.1 times the base gauge G, for example at least 2 times the base gauge G and/or less than 3.33 times the base gauge. Thus, the pitch is preferably between 2.5 and 13 times the base gauge G, for example between 2.75 and 7.8 times the base gauge and more preferably at least 3.65 times the base gauge G.

Each tooth may have a rounded sheet engaging surface with a first radius $r_1$ in a first direction and/or a second radius $r_2$ in a second direction along the rows. The first direction may be at an acute angle in relation to the second direction. The second radius $r_2$ may be less than or equal to the first radius $r_1$.

As used herein, the term "radius" refers to the distance between the centre of the tooth base plane and the tooth face as measured along an imaginary plane extending in the direction of the radius $r_1$, $r_2$, $r_3$, $r_4$ whilst the term "radius of curvature" refers to the actual surface radius at a specific point on the surface of the tooth forming portion. Thus, a "radius" $r_1$, $r_2$, $r_3$, $r_4$ may be a compound radius of curvature having two or more radii of curvature blended together.

For the avoidance of doubt, the "direction" of a radius $r_1$, $r_2$, $r_3$, $r_4$ refers to the direction in which the plane of that radius $r_1$, $r_2$, $r_3$, $r_4$ extends.

According to a seventh aspect of the invention, there is provided a tool for cold forming sheet material, the tool comprising rows of teeth on its outer surface, each tooth having a rounded sheet engaging surface with a first radius $r_1$ in a first direction and a second radius $r_2$ in a second direction along the rows, the first direction being at an acute angle in relation to the second direction, wherein the second radius $r_2$ is less than the first radius $r_1$.

The pitch P between adjacent teeth in a row may be at least 3.3, for example at least 3.32, times the first and/or second radii $r_1$, $r_2$. Preferably, the pitch P between adjacent teeth in a row is at least 3.3, for example at least 3.32, times the second radius $r_2$ measured at the point of the tooth nearest the adjacent tooth from the other tool. It is postulated that this arrangement provides sufficient clearance to avoid material pinching in use.

According to a eighth aspect of the invention, there is provided a tool for cold forming sheet material having a base gauge G of 2 mm or greater, the tool comprising rows of teeth on its outer surface, each tooth having a rounded sheet engaging surface with a radius of curvature R greater than or equal to 2 mm and a pitch of less than 26 mm.

Preferably, the radius of curvature R is less than or equal to 6.7 mm and/or the pitch is less than 15.6 mm such as between 5 mm and 15.6 mm, for example between 5 mm and 7.8 mm.

The tool or tools may comprise a first dimension and a second dimension, for example where the second dimension is orthogonal to the first dimension. The rows may extend in the direction of the first and/or the second dimensions. Alternatively, the rows may extend in a direction between the first and second dimensions.

The tool or tools may comprise cylindrical rolls, for example which are rotatable about respective axes, which axes may be parallel to one another. The teeth may be arranged in helical rows. Each tooth may have a sheet engaging forming portion which is substantially free of sharp corners and/or comprises the sheet engaging surface. The first dimension may comprise a circumferential dimension and/or the second dimension may comprise an axial dimension. In this embodiment there is preferably a minimum clearance, in use, between the peak of each tooth on the one tool and the root diameter of the other tool, for example to ensure material to be formed is not pinched therebetween.

According to an ninth aspect of the invention, there is provided a tooth for cold forming sheet material, the tooth comprising a rounded sheet engaging surface with a first radius $r_1$ in a first direction and a second radius $r_2$ in a second direction, the first direction being at an acute angle in relation to the second direction, wherein the second radius $r_2$ is less than the first radius $r_1$.

According to a tenth aspect of the invention there is provided a tooth for cold forming sheet material, the tooth comprising a rounded sheet engaging surface with a part spherical surface having a single radius of curvature R about a peak of the tooth which blends in to a surface having a different radius of curvature R.

A further aspect of the invention provides a tooth for cold working sheet material, the tooth having a rounded sheet engaging surface, a symmetrical part of the periphery of the tooth extending from the apex to up to 90° to define an at least part-spherical surface, the radii of curvature R of the periphery outside the part spherical surface being blended in to that of the at least part spherical surface so as to form a smooth, continuous transition.

The sheet engaging surface is preferably free of sharp corners. The teeth may comprise forming portions free of sharp corners.

Each tooth may further comprise a third radius $r_3$, for example in the third direction orthogonal to the first direction, and/or a fourth radius $r_4$, for example in a fourth direction orthogonal to the second direction. The third radius $r_3$ may be equal to the first radius $r_1$ and/or the fourth radius $r_4$ may be equal to the second radius $r_2$.

The tooth may have compound or blended radii of curvatures, such that the radius of curvature on one part of the tooth's periphery blends smoothly and continuously into a second radius of curvature on another part of the tooth's periphery.

The pitch P and/or the radii $r_1$, $r_2$, $r_3$, $r_4$ and/or the spacing of the rolls are preferably selected such that the tooth forming portions cause the aforementioned plastic strain and/or material thinning to the sheet material, in use.

According to a further aspect of the invention, there is provided a method of forming sheet material, the method comprising providing a sheet material having a base gauge G, providing a pair of opposed tools having rows of teeth on their outer surface, placing the sheet material between the tools and moving the tools such that rounded sheet engaging surfaces of the teeth on one tool urge portions of the sheet material into gaps between the teeth on the other tool to form projections in the sheet material, wherein during movement of the tools the apex or peak of the projections are free from contact with the other tool.

According to a further aspect of the invention, there is provided a method of forming sheet material, the method comprising providing a sheet material having a base gauge G, providing an apparatus as described above, placing the sheet material between the tools and moving the tools such that the teeth on one tool urge portions of the sheet material into gaps between the teeth on the other tool thereby to form sheet material.

According to a further aspect of the invention, there is provided a method of forming sheet material, the method comprising providing a sheet material having a base gauge G, providing a pair of opposed tools as described above, placing the sheet material between the tools and moving the tools such that the teeth on one tool urge portions of the sheet material into gaps between the teeth on the other tool thereby to form sheet material.

According to a further aspect of the invention, there is provided a method of forming sheet material, the method comprising providing a sheet material having a base gauge G, providing a pair of opposed tools, at least one of which includes a tooth as described above on its periphery, placing the sheet material between the tools and moving the tools such that the tooth urges a portion of the sheet material into gaps between teeth on the other tool thereby to form sheet material.

According to a further aspect of the invention, there is provided a method of forming sheet material, the method comprising providing a sheet material having a base gauge G, providing a pair of opposed tools having rows of teeth on their outer surface, placing the sheet material between the tools and moving the tools such that rounded sheet engaging surfaces of the teeth on one tool urge portions of the sheet material into gaps between the teeth on the other tool to form projections in the sheet material having a substantially continuous region of peak plastic strain at, toward or about their apex and/or are thinned by no more than 25% of its base gauge G.

The method may further comprise shaping the formed sheet material, for example into a channel section.

One embodiment of the invention will now be described, by way of example only, with reference to the accompanying drawings, in which.

Figure 1:
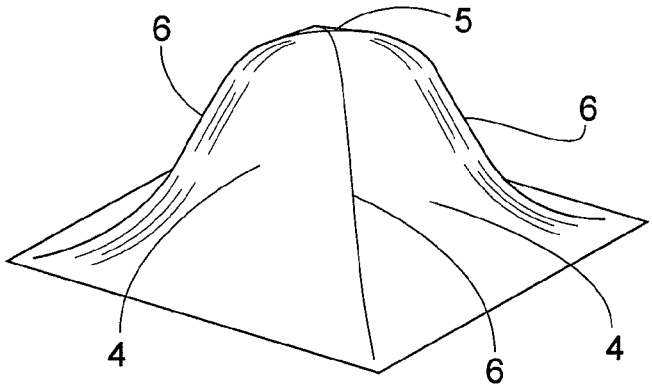
FIGURE 1 PRIOR ART
FIG. 1 is a perspective view of a tooth according to the prior art.
Figure 2:
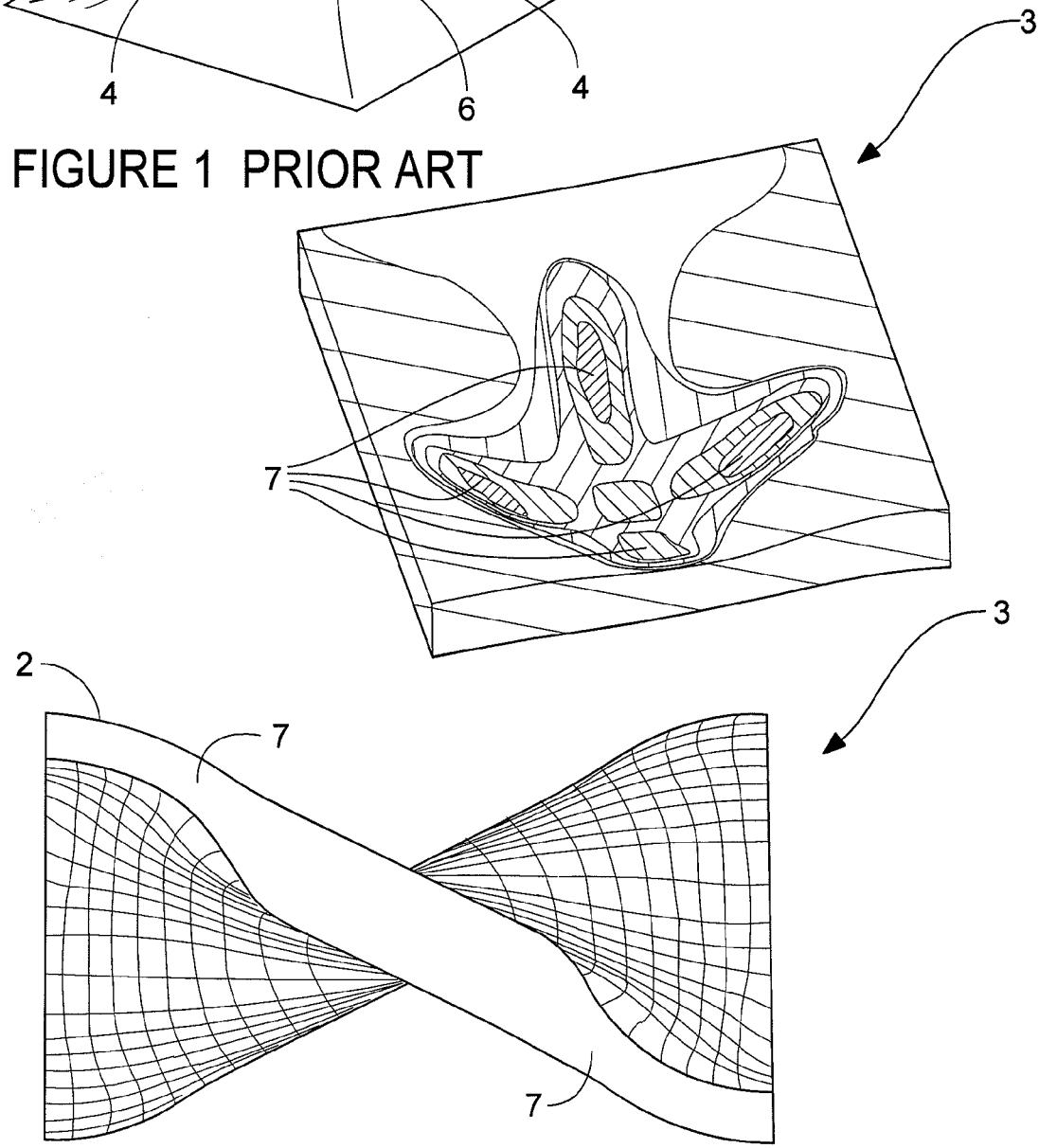
FIGURE 2 PRIOR ART
FIG. 2 is a representation of the strain distribution across a projection formed in sheet material using the tooth of FIG. 1.

FIG. 1 illustrates a prior art roll tooth 1 of the kind disclosed in EP0891234 (which is owned by the current applicant) for forming a projection 2 in sheet material 3 as shown in FIG. 2. The roll tooth 1 is a cross cut involute gear form having four flanks 4 merging to a substantially flat peak 5. The forming rolls (not shown) will include a plurality of such teeth 1, wherein the teeth 1 on adjacent rolls (not shown) intermesh to deform the sheet material 3.

The geometry and density of the teeth 1 across the surface of the rolls (not shown) is dependent upon specific requirements of the application. For example, an increase in the depth of intermeshing and/or an increase in the density of teeth 1 will result in a greater degree of work hardening as well as a greater reduction in overall length of the material.

We have observed through extensive experimentation that the practical range of depth and/or density of teeth 1 on the roll (not shown) for producing useful sheet material of the kind specified is also limited by the resulting degree of material thinning, which worsen the mechanical properties of the material. The equipment and methods of producing sheet material of the kind specified therefore requires a balance between the density and intermeshing of the teeth versus the degree of material thinning in order to optimise the forming process.

On further investigation, we have surprisingly determined that the sharp corners 6 between the flanks 4, which are formed as a result of the manufacturing process, cause areas 7 of peak plastic strain.

As a result, a higher degree of work hardening and thinning of the material is experienced in these areas 7. The resulting strain distribution is illustrated in FIG. 2. Without wishing to be limited by any particular theory we now postulate that difficulties in forming sheet material of the kind specified using a relatively thick sheet material, for example having a thickness above 1.5 mm, may be attributed to this phenomenon.

It is from these surprising realisations that we have conceived and developed the present invention.

Figure 3:
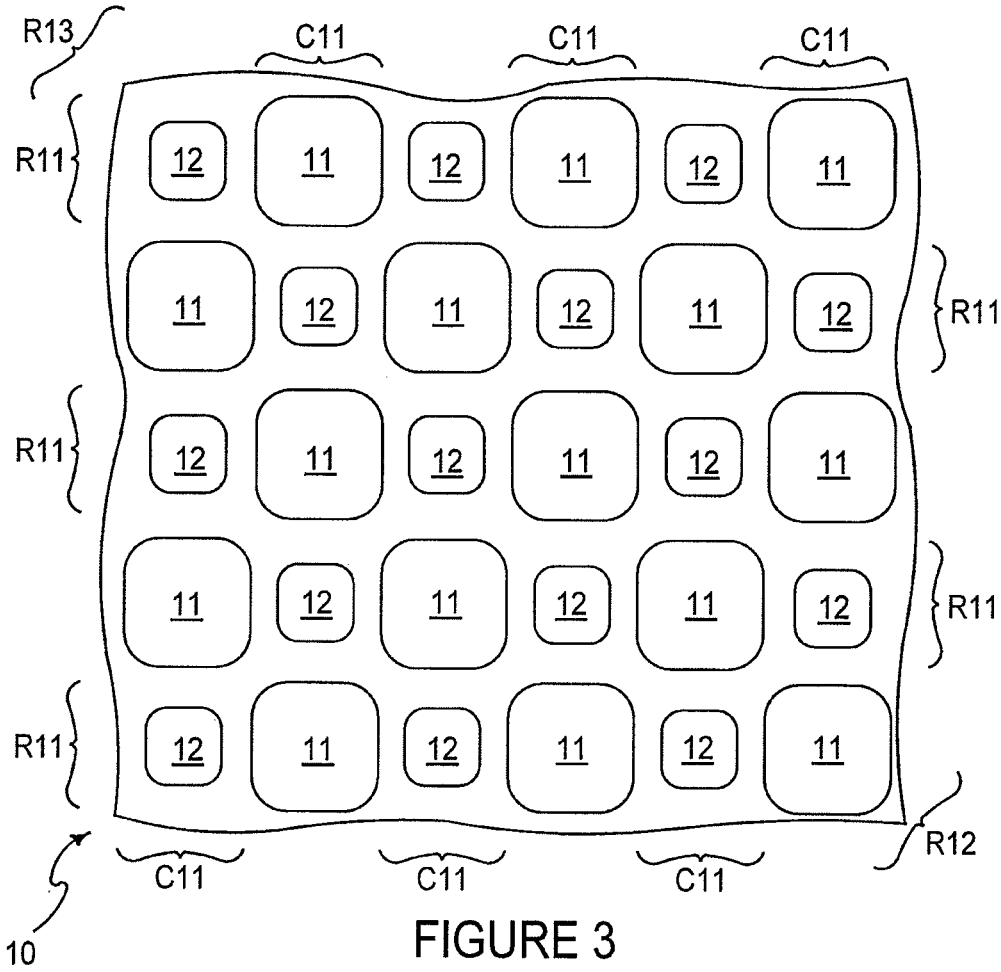
FIG. 3 is a plan view of a fragment of one embodiment of sheet material according to the invention.

Referring now to FIG. 3, there is shown a fragment of formed sheet material 10 comprising mild steel having on both of its faces a large number of projections 11 and depressions 12, each projection 11 at one face corresponding to a depression 12 at the other face. The projections 11 and depressions 12 are substantially square in shape with rounded corners.

The projections 11 and depressions 12 at one face are arranged in rectilinear rows R11 and columns C11, wherein each row R11 and each column C11 comprises alternating projections 11 and depressions 12. There are also alternating respective rows R12, R13 of projections 11 and depressions 12 which extend along a line between the directions of the rows R11 and columns C11. The rows R12, R13 extend at 45° to the rows R11 and the columns C11 in this embodiment. These rows are referred to hereinafter as helical rows R12, R13. The angle can range from 0° to 180°.

Adjacent projections 11 and depressions 12 are sufficiently close to one another for there to be no substantially flat areas of sheet material between them. Thus, the sheet material 10 as viewed in any cross-section which is generally perpendicular to the nominal or actual plane of the sheet material 10 is undulatory, thereby resulting in an effective thickness, or amplitude A, which is greater than the base gauge G of the material.

Figure 4:
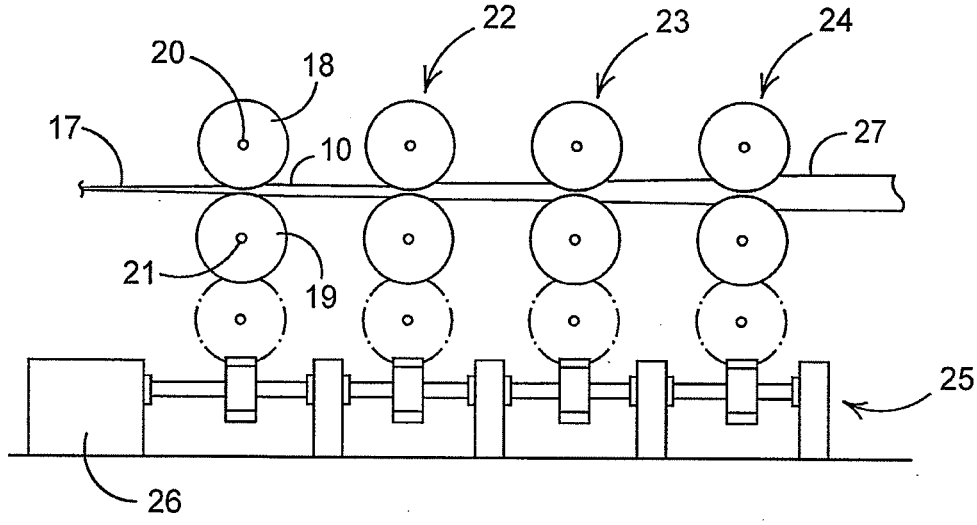
FIG. 4 is a diagrammatical illustration of the forming of sheet material using one embodiment of apparatus according to the invention.

The formed sheet material 10 illustrated in FIG. 3 is formed by the process illustrated in FIG. 4. In this process, plain or base sheet material 17 having a base gauge G is drawn from a coil (not shown) and passes between a pair of rolls 18 and 19, each of which has at its periphery a number of teeth 30. The rolls 18, 19 are rotated about respective parallel axes 20 and 21 and the base sheet material 17 is engaged and deformed by the teeth 30 of the rolls 18, 19. Each tooth 30 pushes a part of the base sheet material 17 into a gap between teeth 30 on the other roll 18, 19 to form a projection 11 facing that other roll 18, 19 and a corresponding depression 12 facing the one roll 18, 19, thereby providing the formed sheet material 10. Thus, the overall thickness of the base sheet material 17 is increased by the presence of projections 11 on both of its faces and providing an effective thickness, or amplitude A, in the formed sheet material 10.

From the roll pair 18 and 19, the sheet material 10 may then pass between further roll pairs 22, 23 and 24 to shape the formed sheet material 10 into a channel section 27 in this embodiment. Other elongate shaped members (not shown) may also be formed.

The roll pair 18 and 19 and the further roll pairs 22, 23 and 24 are all driven by common drive means 25 of known form and preferably including an electric motor 26. The roll pairs 18 and 19, 22, 23, 24 are driven at substantially the same peripheral speed so that the base sheet material 17 passes continuously and at the same speed between the rolls 18 and 19 as the formed sheet material 10 passes between the subsequent further roll pairs 22, 23, 24.

After the formed sheet material 10 has been shaped into a channel or other section 27, it may be cut into lengths (not shown) for transportation and use.

Figure 5:
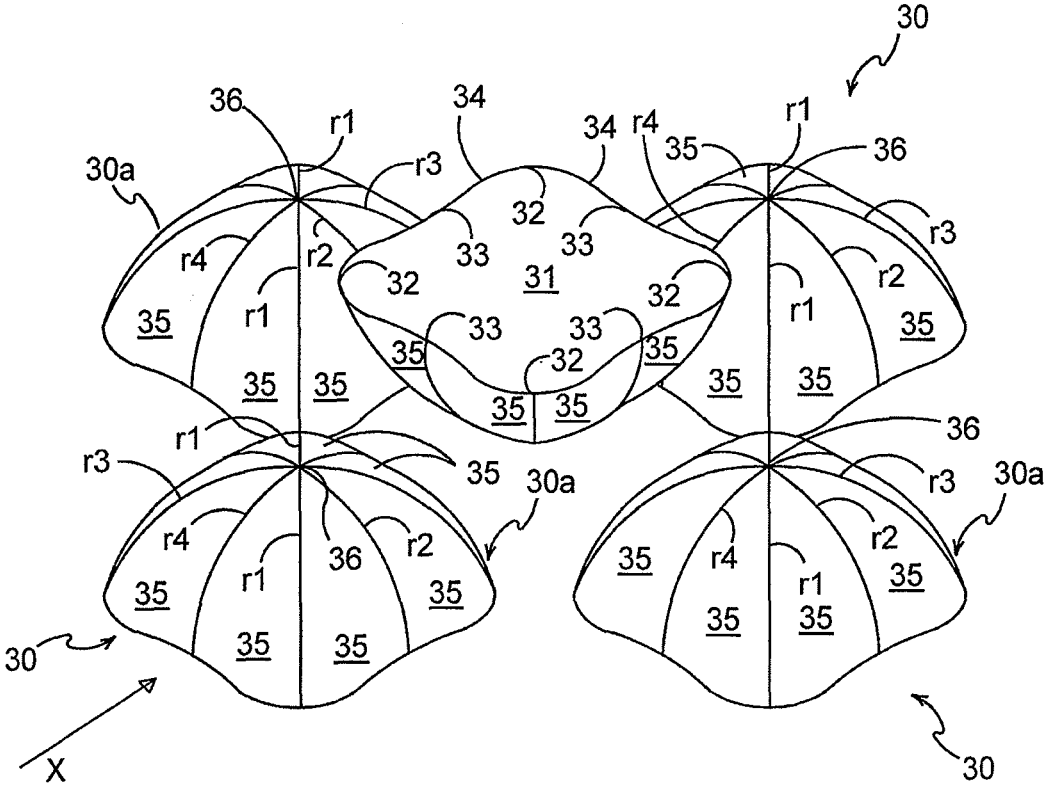
FIG. 5 is a perspective view of the cooperation of a group of teeth having a first embodiment of tooth forming portions.
Figure 6:
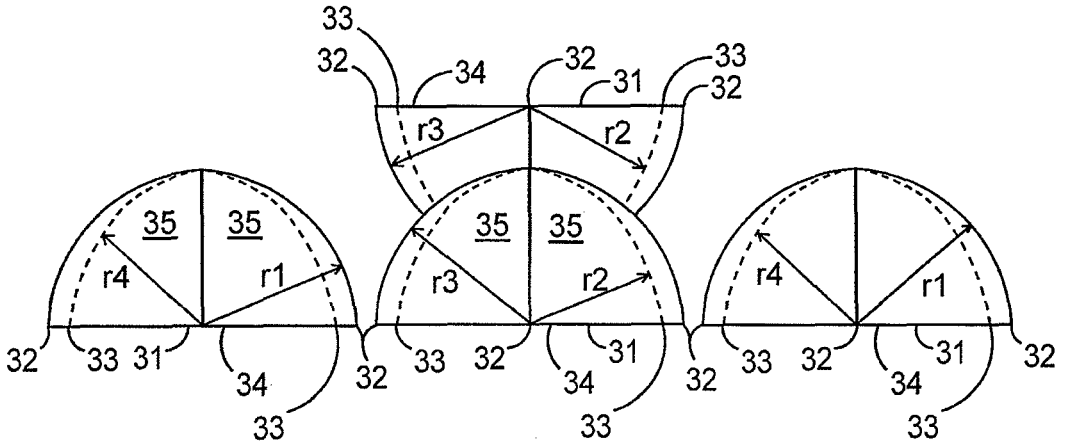
FIG. 6 is a side view of the tooth forming portions of FIG. 5 from direction X.

Both of the rolls 18, 19 have substantially the same form with a first dimension, or axial length in this embodiment, and a second dimension orthogonal to the first, or circumferential dimension in this embodiment. Each roll 18, 19 includes a plurality of identical teeth 30 on its periphery, each of which teeth 30 includes a tooth forming portion 30*a* as shown in FIG. 5. The teeth 30 are arranged in a plurality of rows which correspond to the rows R11, R12, R13 and columns C11 of the formed sheet material. It will be appreciated that the helical rows R12, R13 of teeth 30 extend along lines which extend between lines lying along the first and second dimensions. In this embodiment, the helical rows (not shown) are inclined to the axis 20, 21 of the roll 18, 19 at an angle of 45°.

Each tooth forming portion 30 is formed integrally with a tooth base portion (not shown) which in turn is formed integrally or otherwise secured to the periphery of one of the rolls 18, 19. It will be appreciated that the tooth base portions (not shown) are sized and dimensioned such that they do not impede deformation of the material in use.

The first embodiment of tooth forming portions 30*a* have a geometry and cooperating layout as illustrated in part in FIGS. 5 to 8. Each tooth forming portion 30*a* includes a base plane 31 which is substantially square in shape having rounded corners 32 and a smoothed depression 33 at the mid point of each side edge 34, thereby forming a four lobed shape. The side surfaces 35 of the tooth forming portion 30 project upward from the side edges 34 of the base 31 and curve toward a common smoothed apex 36, thus forming a rounded sheet engaging surface. It will be appreciated that there are no sharp corners present on the tooth forming portions 30*a*.

The features of the shape of the tooth forming portion 30*a* are defined by a series of radii $r_1$, $r_2$, $r_3$, $r_4$, each of which has a constant radius of curvature in this embodiment. However, the first and third radii $r_1$, $r_3$ are different from the second and fourth radii $r_2$, $r_4$ in this embodiment.

As used herein, the term "radius" refers to the distance between the centre of the tooth base plane 31 and the tooth face 35 as measured along an imaginary plane extending in the direction of the radius $r_1$, $r_2$, $r_3$, $r_4$ (as shown more clearly in FIG. 6) whilst the term "radius of curvature" refers to the actual surface radius at a specific point on the surface of the tooth forming portion 30*a*. Thus, a "radius" $r_1$, $r_2$, $r_3$, $r_4$ may be a compound radius of curvature having two or more radii of curvature blended together.

For the avoidance of doubt, the "direction" of a radius $r_1$, $r_2$, $r_3$, $r_4$ refers to the direction in which the plane of that radius $r_1$, $r_2$, $r_3$, $r_4$ extends.

The first and third radii $r_1$, $r_3$ are orthogonal to one another and each extends in a direction between the first and second directions (i.e. between the axial and circumferential directions of the rolls 18, 19). As is shown, $r_1$, $r_3$ both extend at 45° to the first direction in this embodiment. The second and fourth radii $r_2$, $r_4$ extend respectively along the axial direction and circumferential (i.e. rolling) direction. The pitch P between adjacent teeth 30 is equal in this embodiment along both the rectilinear rows R11 and columns C11.

Figure 7:
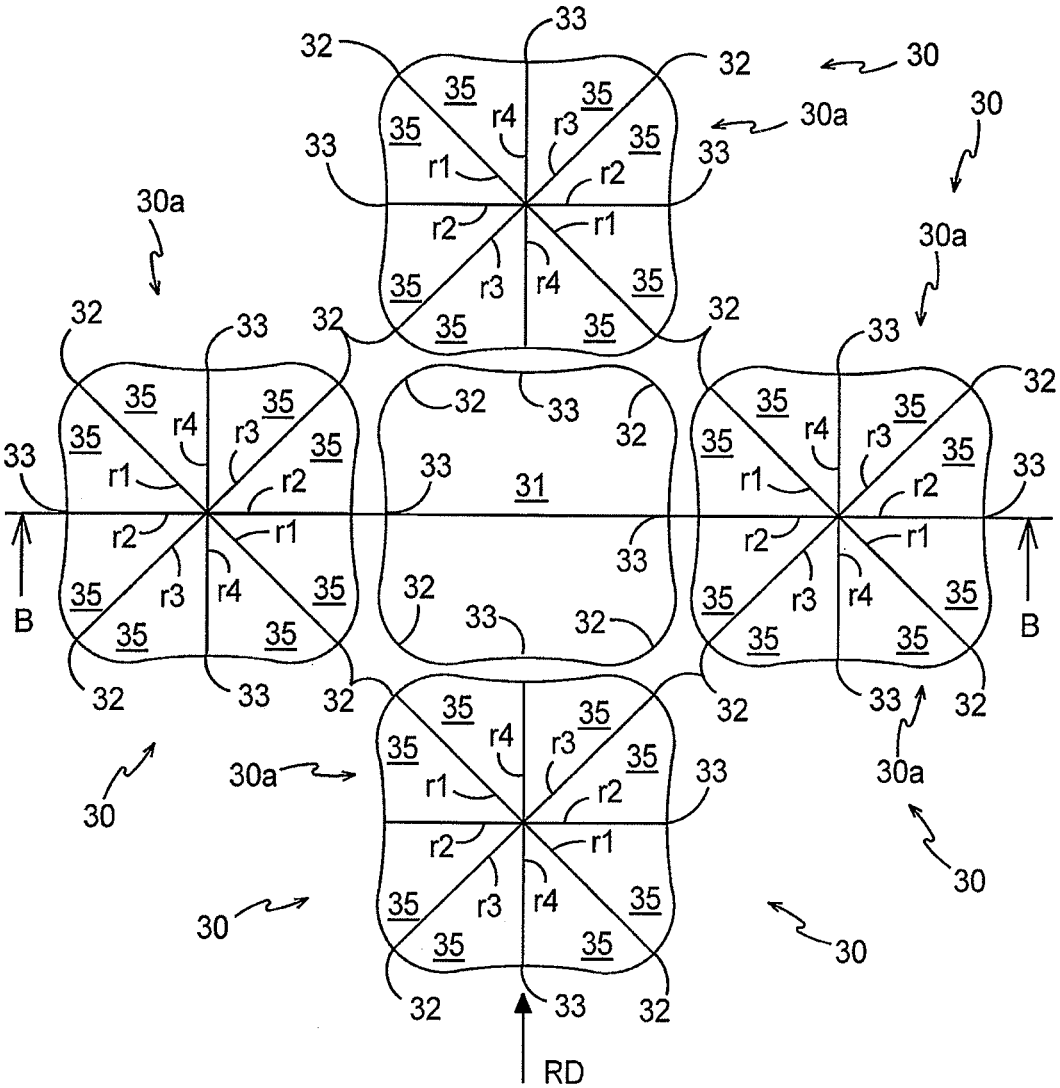
FIG. 7 is a plan view of the tooth forming portions of FIG. 5.

In use, the sheet material 10 is passed through the rolls 18, 19 in the rolling direction RD (shown in FIG. 7). Each tooth forming portion 30 from one of the rolls 18, 19 moves into and out of alignment with the space between adjacent tooth forming portions 30 in the other of the rolls 18, 19 as shown more clearly in FIGS. 5 to 8. As can be seen from FIG. 8, the amplitude A of the formed sheet material 10 is a function of the depth D of penetration, or overlap, between the forming portions 30*a*, which in turn is a function of the separation of the rolls 18, 19.

The spacing and geometry of the teeth 30 in this embodiment are such that the apex or peak of a projection 11 being formed by one of the teeth 30 on one of the rolls 18, 19 is free from contact with other the roll 18, 19. This can be seen, for example, in FIG. 8.

The amplitude A of the sheet material leaving the rolls 18 and 19 is preferably between 1.5 to 4, say 2 and 3, times the base gauge G of the sheet material. However, it will be appreciated that subsequent shaping of the sheet material by the roll pairs 22, 23 and 24 can reduce the amplitude A of the formed sheet material 10.

As mentioned above, the improvements in physical properties of sheet material of the kind specified are mainly attributed to the increase in effective thickness of the sheet material and the strain hardening effect which is a consequence of the plastic deformation of the material. It is therefore desirable to maximise the effective thickness or amplitude A of the formed material 10 and to maximise both the magnitude and area of plastic strain. Increasing the amplitude A will increase the magnitude of plastic strain and decreasing the pitch P will increase the area of plastic strain because of an increase in projection density.

However, the greater the magnitude of plastic strain, the greater the extent of material thinning, which adversely affects the physical properties of the sheet material.

We have determined that there is a preferable or optimum sheet engaging surface radius R which provides a balance between maximising work hardening and minimising the material thinning.

However, as mentioned above, it is desirable to minimise the pitch P in order to maximise the area of plastic strain. It has been observed that the sheet material is 'pinched' when the clearance between adjacent forming portions 30*a* approaches and is less than the base gauge G in use. Whilst material pinch is beneficial in terms of plastic strain and therefore strain hardening of the formed material, it can result in local thinning of the sheet material and it causes issues in manufacture due to excessive loads and roll wear issues. It is therefore preferable to avoid material pinch.

The present invention provides a tooth form which enables a balance to be struck between these competing factors. This is achieved by providing a rounded sheet engaging surface having a radius of curvature equal to the preferable surface radius R in some areas while the radius of curvature in other areas is adjusted to prevent pinching.

Material pinching occurs in the regions where there is the least distance between intermeshing teeth. In the case of the first embodiment of tooth forming portion 30*a*, this is in the direction of the rectilinear rows R11 and columns C11 (i.e. direction of $r_2$ and $r_4$).

Accordingly, in this embodiment the radii $r_1$, $r_3$ of the sheet engaging surface have a radius of curvature equal to the preferable surface radius R, while the radii $r_2$, $r_4$ gradually decrease from the peak to the base portion (not shown). This provides a profile which allows for a reduced pitch P to maximise the strained area, while providing a degree of extra clearance to avoid pinching the material.

We have determined that by ensuring that the pitch P is at least 2.5 times, preferably at least 3 times, for example 3.32 times, the preferable surface radius R (i.e. the first and third radii $r_1$, $r_3$ in this embodiment) the level of strain can be maximised.

The surface radius along the radii $r_1$, $r_2$, $r_3$ and $r_4$ should be at least equal to the base gauge G, preferably 1.1 or more times the base gauge G, of the sheet material in order to ensure a relatively even strain distribution throughout the projection 11 and to minimise thinning.

Figure 8:
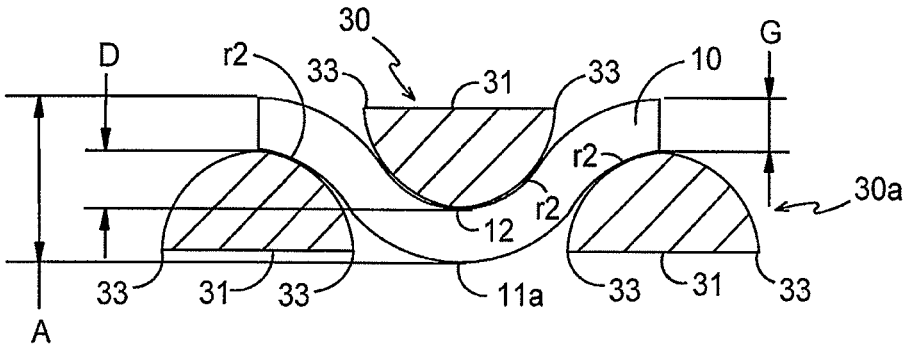
FIG. 8 is a cross-section view along line B-B of FIG. 7 showing sheet material being formed between the tooth forming portions.
Figure 8A:
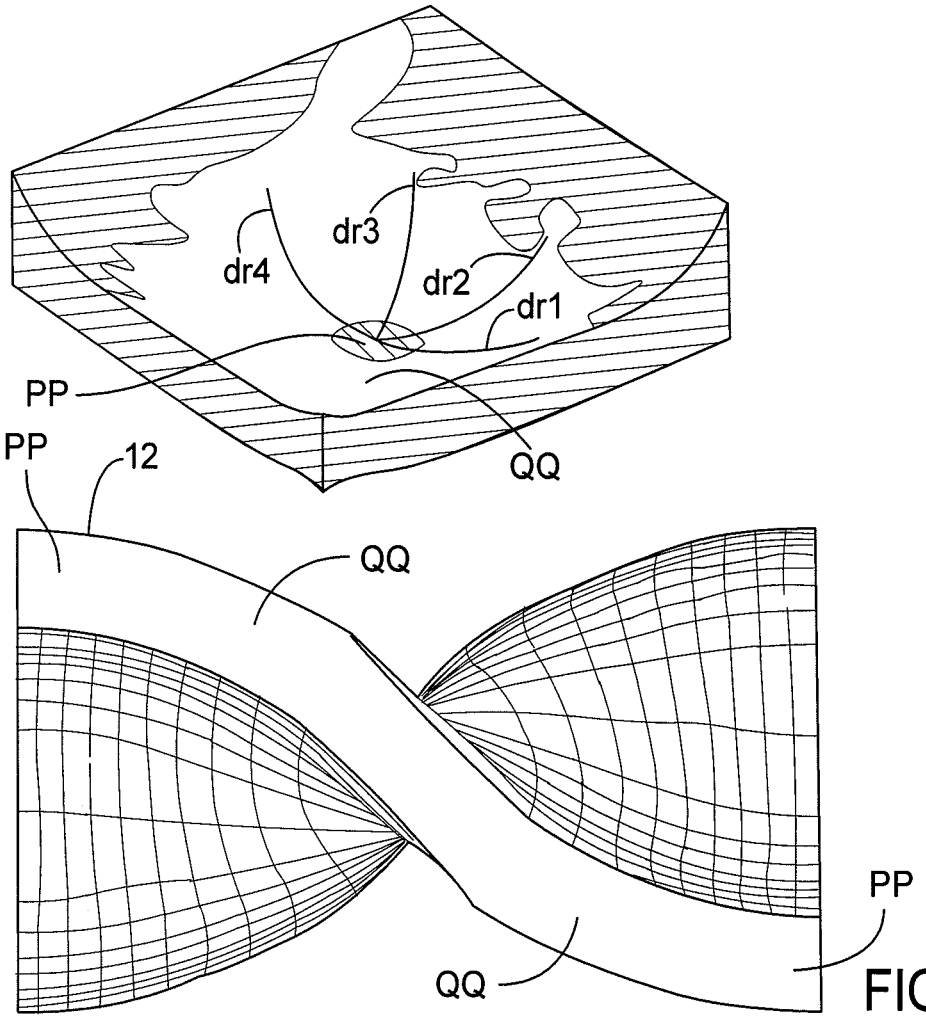
FIG. 8A is a representation of the strain distribution across a projection formed in sheet material using the tooth of FIG. 8.

FIG. 8*a* shows a representation of the plastic strain of a part of the sheet material 10 formed using the tooth geometry shown in FIGS. 5 to 8. As shown in FIG. 8*a*, there is a continuous area of peak plastic strain PP around the apex of the projection 11, while the plastic strain in the quaquaversal region QQ surrounding the area PP decreases moving away from that region. The sheet material is thinned by less that 25%.

The base of the depression 12 includes four radii $dr_1$, $dr_2$, $dr_3$ and $dr_4$, which correspond generally to the four radii $r_1$, $r_2$, $r_3$ and $r_4$ of the sheet engaging surface of the tooth.

In order to further demonstrate the flexibility of the invention, reference is made to the further tooth forms shown in FIGS. 9 to 13.

Figure 9:
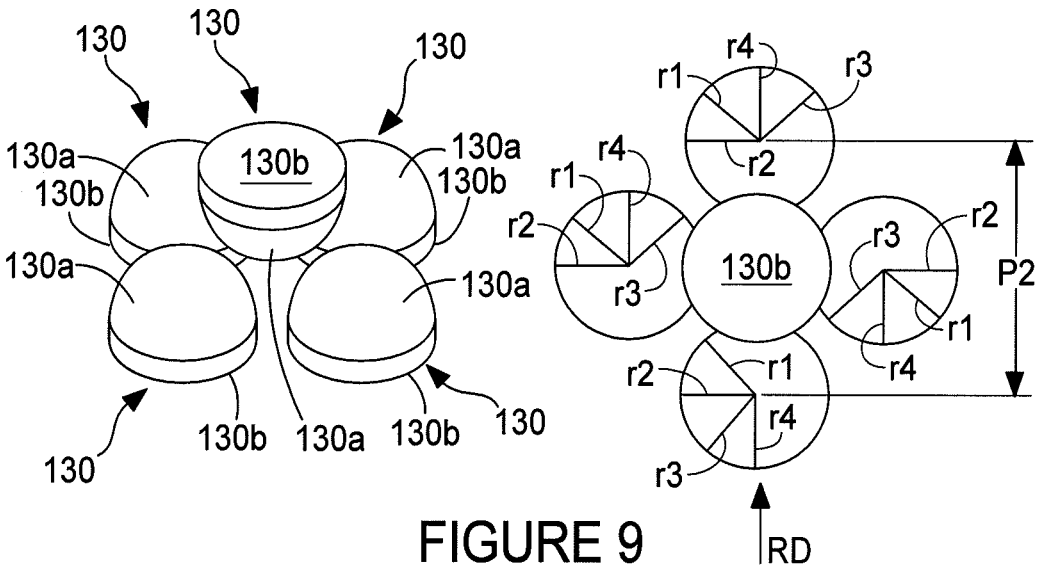
FIG. 9 shows a second embodiment of tooth forming portions.

FIG. 9 shows a second embodiment of tooth 130 which includes a forming portion 130*a* of hemispherical form and a cylindrical base portion 130*b* formed integrally with the forming portion 130*a*. In this case, all radii $r_1$, $r_2$, $r_3$ and $r_4$ are equal to the preferable surface radius R and the pitch $P_2$ is such that no material pinching occurs. It will be appreciated that the pitch $P_2$ required to prevent material pinching will be greater for this embodiment since the second and fourth radii $r_2$, $r_4$ are equal to the first and third radii $r_1$, $r_3$.

Figure 10:
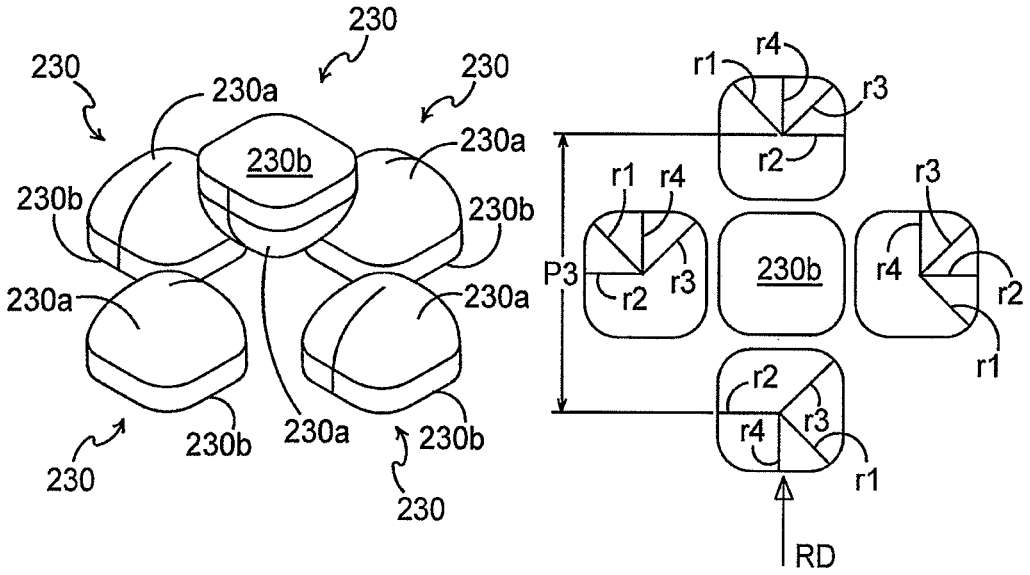
FIG. 10 shows a third embodiment of tooth forming portions.

FIG. 10 shows a third embodiment of tooth 230 which includes a forming portion 230*a* formed integrally with a base portion 230*b* that is generally square in plan with rounded corners. The first and third radii $r_1$, $r_3$ in this embodiment are both equal to the preferable surface radius R, whereas the second and fourth radii $r_2$, $r_4$ each comprise a compound radius gradually decreasing toward the base portion 230*b* to provide suitable clearance and thereby reduce the potential for material pinch. This tooth form 230 allows for a reduced pitch $P_3$ with respect to the pitch $P_2$ of the second embodiment, thereby increasing the density of projections 11 and improving the proportion of the formed sheet material 10 which is strain hardened.

Figure 11:
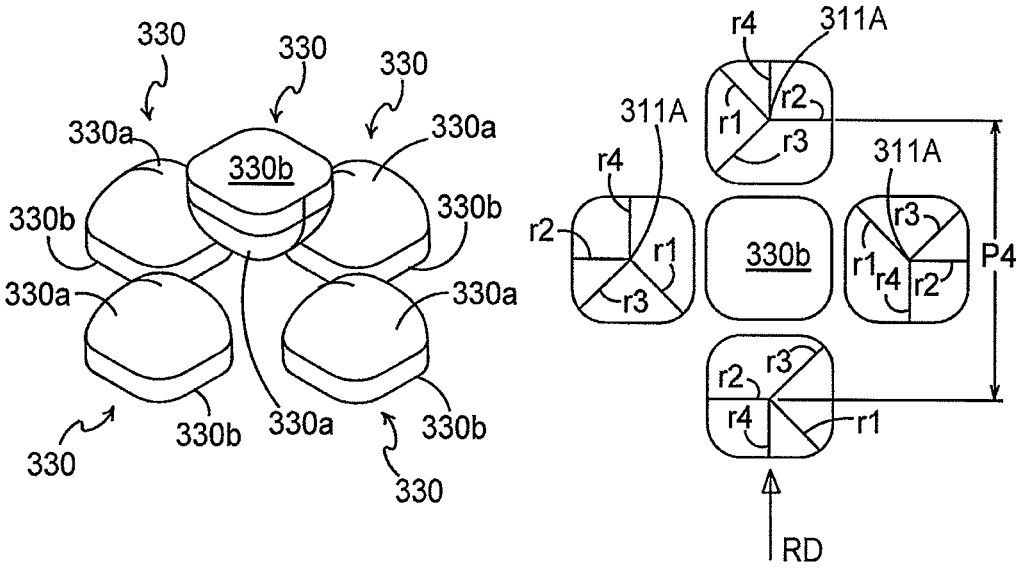
FIG. 11 shows a fourth embodiment of tooth forming portions.

FIG. 11 shows a fourth embodiment of tooth 330 which includes a forming portion 330*a* formed integrally with a base portion 330*b* that is also generally square in plan with rounded corners. The first and third radii $r_1$, $r_3$ in this embodiment are both equal to the preferable surface radius R at or adjacent to the peak 311*a* of the tooth 330 and comprise a compound radius gradually decreasing toward the base portion 330*b*. The second and fourth radii $r_2$, $r_4$ have a single radius of curvature and are smaller than the first and third radii $r_3$ to provide suitable clearance and thereby reduce the potential for material pinch. This tooth form 330 allows for a reduced pitch $P_4$ with respect to the pitch $P_2$ of the second embodiment since the size of the base portion 330*b* can be reduced for a given preferable surface radius R, thus increasing the worked area of the sheet material 10.

Figure 12:
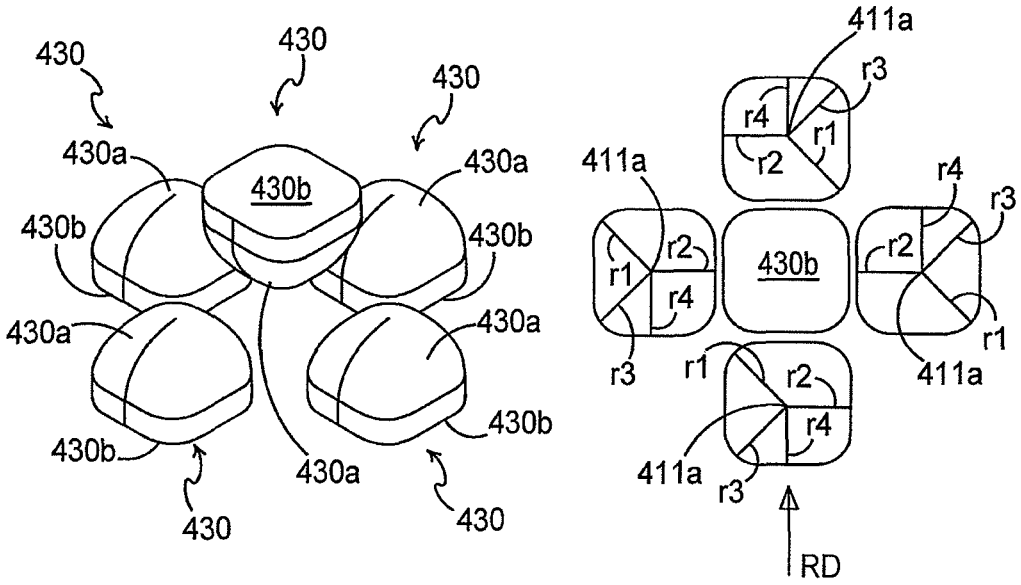
FIG. 12 shows a fifth embodiment of tooth forming portions.

FIG. 12 shows a fifth embodiment of tooth 430 which includes a forming portion 430*a* formed integrally with a base portion 430*b* that is also generally square in plan with rounded corners. The first and third radii $r_1$, $r_3$ in this embodiment are both equal to the preferable surface radius R at or adjacent to the peak 411*a* of the tooth 430 and comprise a compound radius gradually decreasing toward the base portion 430*b*. The second and fourth radii $r_2$, $r_4$ each comprise a compound radius gradually decreasing toward the base portion 430*b* to provide a region having a suitable clearance and thereby reduce the potential for material pinch. The four compound radii $r_1$, $r_2$, $r_3$, $r_4$ of the tooth form 430 provide maximum flexibility for optimising the balance between the degree of work hardening and avoiding material pinch.

Figure 13:
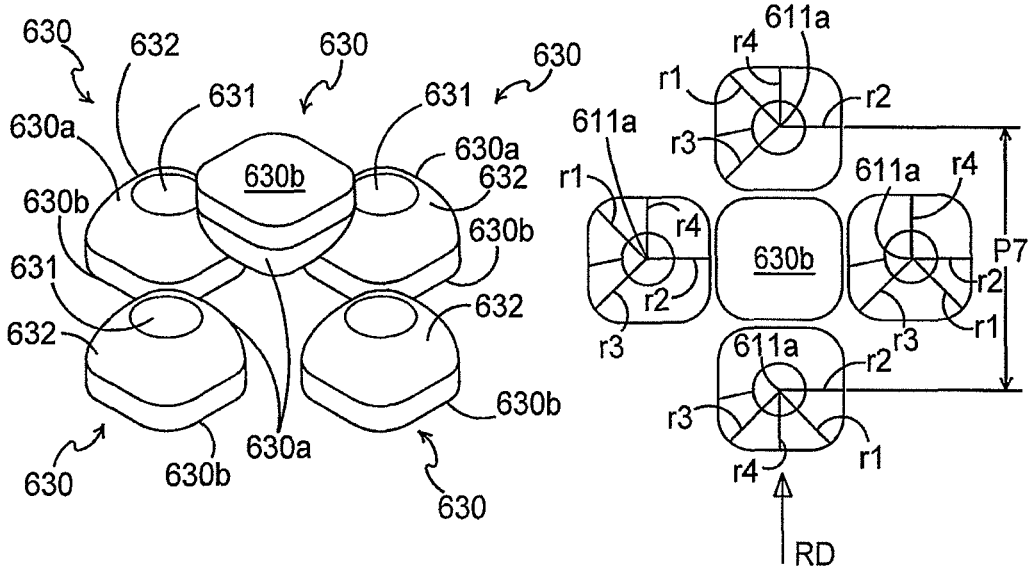
FIG. 13 shows a sixth embodiment of tooth forming portions.
Figure 14A:
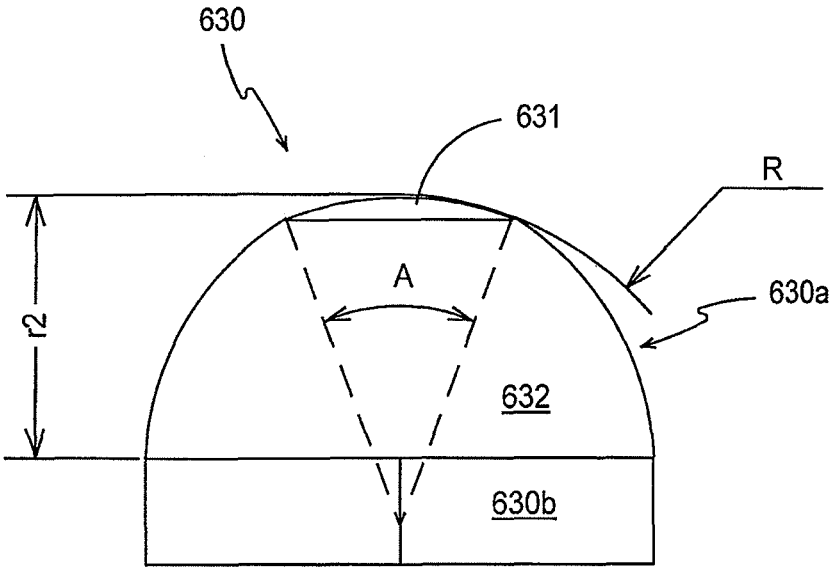
FIG. 14A is a cross-sectional view of one of the tooth forming portions of FIG. 13.
Figure 14B:
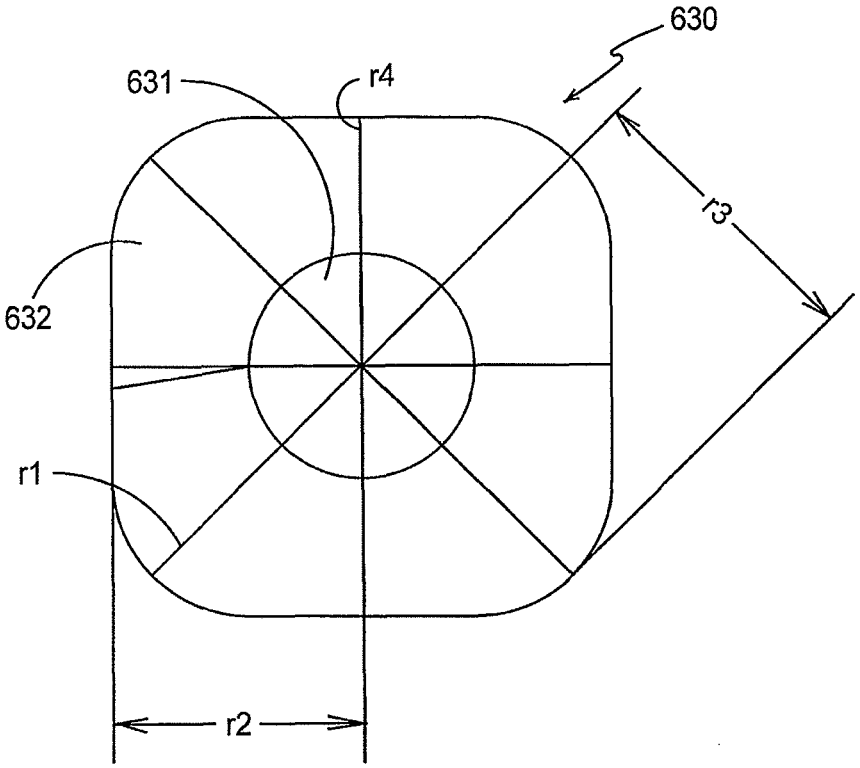
FIG. 14B is a top view of one of the tooth forming portions of FIG. 13.

FIGS. 13, 14A and 14B show a sixth embodiment of tooth 630 which includes a forming portion 630*a* formed integrally with a base portion 630*b* that is generally square in plan with rounded corners. All of the radii $r_1$, $r_2$, $r_3$, $r_4$ in this embodiment are equal to the preferable surface radius R at and adjacent to the peak 611*a* of the tooth 430 to provide a part spheroidal surface 631 and comprise a compound radius gradually decreasing toward the base portion 430*b* extending from and blended with the part spheroidal surface 631. The second and fourth radii $r_2$, $r_4$ each comprise a compound radius which gradually decreases toward the base portion 430*b* by a steeper gradient than the first and third radii $r_1$, $r_3$, thereby providing a region having a suitable clearance to reduce the potential for material pinch.

As shown more clearly in FIGS. 14A and 14B, the part spheroidal surface 631 or tip area 631 is defined by a conical segment with an angle A between 0 and 180°. Clearly, if the angle A approaches 180° then the tooth form 160 will approach that of FIG. 9.

Figure 15:
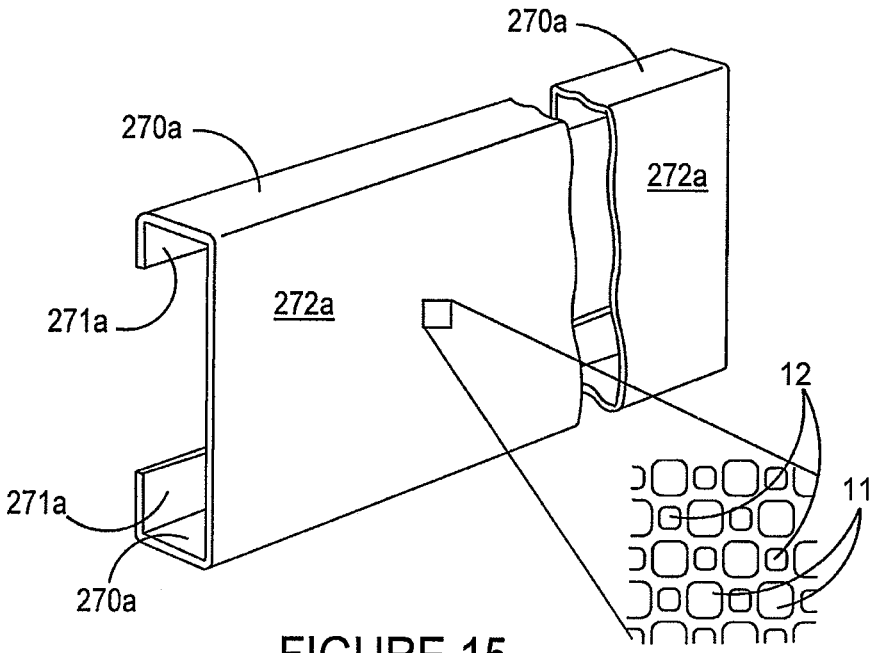
FIG. 15 is a perspective view of sheet material shaped into a first embodiment of channel section.
Figure 16:
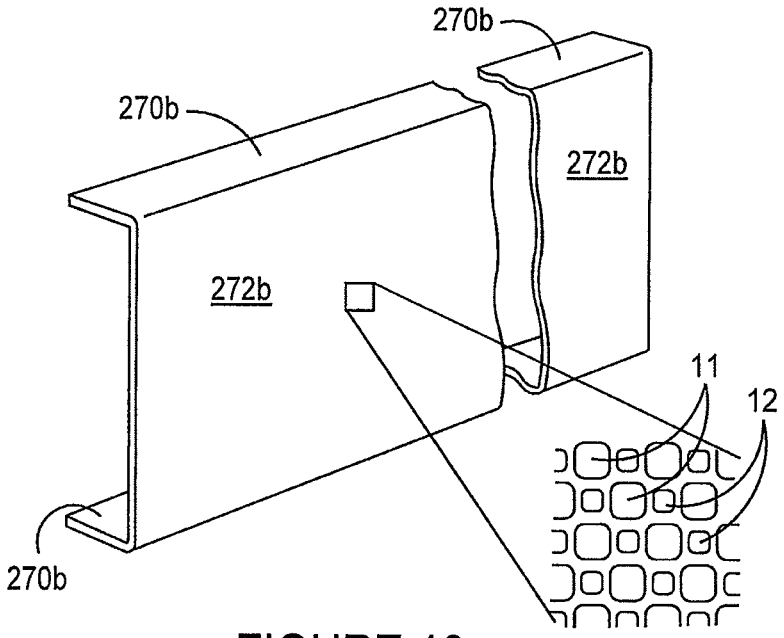
FIG. 16 is a perspective view of sheet material shaped into a second embodiment of channel section.

The shaped sheet material 27 which results from the process illustrated in FIG. 4 is suitable for use on its own or in the form of a structural member 27*a*, 27*b* as shown in FIGS. 15 and 16, for example a post or a beam. For these purposes, sheet material 10 of channel form 27*a*, 27*b* is particularly suitable, the channel 27*a*, 27*b* having flanges 270*a*, 271*a*, 270*b* and a web 272*a*, 272*b* which maintains the flanges 270*a*, 271*a*, 270*b* a predetermined distance apart.

The surfaces of the flanges 270*a*, 271*a*, 270*b* and the web 272*a*, 272*b* include rows (R11, R12, R13) of projections 11 and depressions 12. In certain cases, projections 11 and depressions 12 may be required on only a part of the surface of the sheet material 10. The invention is applicable with especial advantage to studs 27*a*, 27*b* used in stud and panel partitions and to the channel lengths 27*b* in which end portions of the studs 27*a*, 27*b* are received.

For other purposes, generally flat material or section other than a channel 27 are useful, for example C-sections, U-sections, Z-sections, I sections and so on.

Sheet material of the kind specified formed in accordance with the present invention is much stiffer than the plain sheet material from which it is formed. In particular, the bending strength of such material increases dramatically.

Example 1

A specimen of sheet material having a base gauge G of 0.45 mm was formed using a tool comprising the tooth form shown in FIG. 10. The pitch of the teeth on the tool was 5.1 mm, the first and third radii $r_1$, $r_3$ had a constant radius of curvature of 1.5 mm, while the second and fourth radii $r_2$, $r_4$ had a composite radius of curvature.

The sheet material was formed with an amplitude A of 2.5 times the base gauge G of the material 17 with a proportion of significant plastic strain of 70% and material thinning of 15%. The formed sheet material 10 resulted in a 33% increase in bending strength over the plain sheet material from which it was formed, as measured by a 5 mm displacement three point bending test.

Example 2

A further specimen of sheet material having a base gauge G of 0.45 mm was formed using a tool comprising the same tooth form and having the same pitch as in Example 1.

The sheet material was formed with an amplitude A of 3 times the base gauge G of the material 17 with a proportion of significant plastic strain of 88% and material thinning of 23%. The formed sheet material 10 resulted in a 36% increase in bending strength over the plain sheet material from which it was formed, as measured by a 5 mm displacement three point bending test.

Example 3

A specimen of sheet material having a base gauge G of 0.7 mm was formed using a tool comprising the same tooth form and having the same pitch as in Example 1.

The sheet material was formed with an amplitude A of 2 times the base gauge G of the material 17 with a proportion of significant plastic strain of 88% and material thinning of 11%. The formed sheet material 10 resulted in a 48% increase in bending strength over the plain sheet material from which it was formed, as measured by a 5 mm displacement three point bending test.

Example 4

A further specimen of sheet material having a base gauge G of 0.7 mm was formed using a tool comprising the same tooth form and having the same pitch as in Example 1.

The sheet material was formed with an amplitude A of 2.5 times the base gauge G of the material 17 with a proportion of significant plastic strain of 96% and material thinning of 22%. The formed sheet material 10 resulted in a 62% increase in bending strength over the plain sheet material from which it was formed, as measured by a 5 mm displacement three point bending test.

Example 5

A specimen of sheet material having a base gauge G of 2 mm was formed using a tool comprising the tooth form shown in FIG. 9. The pitch of the teeth on the tool was 9.5 mm and the first, second, third and fourth radii $r_1$, $r_2$, $r_3$, $r_4$ all had a constant radius of curvature of 2.5 mm.

The sheet material was formed with an amplitude A of 1.8 times the base gauge G of the material 17 with a proportion of significant plastic strain of 76% and material thinning of 24%. The formed sheet material 10 resulted in a 35% increase in bending strength over the plain sheet material from which it was formed, as measured by a 5 mm displacement three point bending test.

It will be appreciated that several variations to the embodiment disclosed are envisaged without departing from the scope of the invention. For instance, the forming tool or tools need not comprise inter-engaging rolls. Any suitable tool may be used such as a press or other stamping means for example.

There may be a substituted for the roll pair 18, 19 a pair of rolls which are not identical, for example, one having square teeth (not shown) and the other having elongated teeth (not shown).

In place of the roll pairs 22, 23 and 24, there may be provided an alternative device or devices for modifying the sheet material in some other way or alternatively, the sheet may be provided without modification.

Whilst helical rows are inclined at 45 degrees relative to the axis of the rolls, they may be inclined at any angle and/or they need not be arranged in helical rows. The tool need not be rolls, could be, for example, a block with a flat face and/or substantially planar The sheet material is preferably mild steel, which may be galvanised or otherwise coated for protection against corrosion. Modification of initially plain, galvanised mild steel sheet in the manner hereinbefore described leaves the protective coating intact. The base gauge G of the plain sheet material is typically within the range 0.3 to 3 mm.

It has been surprisingly found that the present invention can be used to form material with a base gauge G of 3 mm whilst still showing improved strength and no noticeable material pinching.

As will be appreciated, many alternative radii $r_1$, $r_2$, $r_3$, $r_4$ are envisaged which will result in a number of different forms of rounded sheet engaging surfaces which are consistent with the invention.

The pitch P between adjacent teeth 30 in rows R11 may be different from the pitch P in the columns C11.

As used herein, the term "sheet material" embraces generally flat material, for example such as that which is described in the aforesaid European patent applications and products made by bending or shaping generally flat sheet material, examples of which products are shown in FIGS. 9 and 10 and mentioned in our published International patent application published as WO82/03347.

The invention claimed is:

1. A tool (20) for cold rolling sheet material having a base gauge G, the tool being cylindrical and having an axial dimension extending along an axis of rotation and a circumferential surface having a circumferential dimension extending orthogonally to the axial dimension, the tool having rows (R12, R13) of teeth (30, 130, 230, 330, 430, 630) extending from the circumferential surface, each tooth having a rounded sheet engaging surface, each tooth (30, 130, 230, 330, 430, 630) having:

a first radius $r_1$ extending along a first direction;

a second radius $r_2$ extending along the axial dimension;

a third radius $r_3$ extending in a third direction orthogonal to said first direction, said first and third directions extending between said axial and circumferential directions, said third radius $r_3$ being equal to a radius of curvature R at and adjacent the peak (11, 31*a*, 41*a*, 61*a*) of each tooth, and the pitch between adjacent teeth in a row being at least 3R, said radius of curvature R providing a balance between maximizing work hardening and minimizing sheet material thinning; and a fourth radius $r_4$ extending along the circumferential dimension and wherein at least one of the four radii $r_1$ to $r_4$ is different from the others.

2. A tool according to claim 1, wherein the second radius $r_2$ is the same or less as the first radius $r_1$.

3. A tool according to claim 1, wherein teeth are arranged in helical rows.

4. A tool according to claim 1, wherein each tooth has a substantially square base, in plan.

5. A tool according to claim 1, wherein each tooth is a four lobed base, in plan.

6. A tool according to claim 1, wherein the tool is for cold forming sheet material having a base gauge G of 2 mm or greater, each tooth having a rounded sheet engaging surface with a radius of curvature greater than or equal to 2 mm and a pitch P of less than 26 mm.

7. A tool as claimed in claim 6, wherein the pitch P is less than 15.6 mm.

8. A tool as claimed in claim 1, wherein the tool comprises a cylindrical roll rotatable about an axis.

9. An apparatus comprising first and second tools for cold rolling sheet material having a base gauge G, each of the first and second tools being cylindrical and having an axial dimension extending along an axis of rotation and a circumferential surface having a circumferential dimension extending orthogonally to the axial dimension, each tool having rows (R12, R13) of teeth (30, 130, 230, 330, 430, 630) extending from the circumferential surface, each tooth having a rounded sheet engaging surface, each tooth (30, 130, 230, 330, 430, 630) having:

a first radius r1 extending along a first direction;

a second radius r2 extending along the axial dimension;

a third radius r3 extending in a third direction orthogonal to said first direction, said first and third directions extending between said axial and circumferential directions, said third radius r3 being equal to a radius of curvature R at and adjacent the peak (11, 31*a*, 41*a*, 61*a*) of each tooth, and the pitch between adjacent teeth in a row being at least 3R, said radius of curvature R providing a balance between maximizing work hardening and minimizing sheet material thinning;

a fourth radius r4 extending along the circumferential dimension and wherein at least one of the four radii r1 to r4 is different from the others; and the rotational axis of the first tool being parallel to the rotational axis of the second tool, the geometry and position of the teeth and the spacing of the tools being such that the teeth on the first tool extend, in use, into gaps between the teeth on the second tool with a minimum clearance between the opposing teeth which is at least equal to the base gauge G of the material to be passed through the apparatus.

10. A sheet steel cold forming tool for cold forming sheet steel material having a base gauge G of 2 mm or greater, the tool comprising:

a cylindrical shape and having a rotational axis; and an array of teeth on its outer surface arranged in rows and columns, each tooth having a rounded spheroidal or hemispherical sheet engaging surface free of sharp corners with a radius of curvature greater than or equal to 2 mm and a pitch P between 2.5 and 13 times said base gauge G, the radius of curvature extending in a direction between the rotational axis and a direction orthogonal thereto and wherein said radius of curvature provides a balance between maximizing work hardening and minimizing sheet material thinning for cold forming sheet steel material.

11. A sheet steel cold forming tool for cold forming sheet steel material, the tool comprising:

a cylindrical shape and having a rotational axis; and an array of teeth arranged in rows and columns on its outer surface, wherein each tooth has a rounded sheet engaging surface with a first radius of curvature extending in a direction between the rotational axis and a direction orthogonal thereto, a second radius of curvature extending in the direction of the rotational axis and a third radius of curvature extending in a direction orthogonal to the first direction, wherein the first, second and third radii of curvature are equal, the pitch between adjacent teeth in a row being between 3.0 and 3.9 times the first radius of curvature for cold forming sheet steel material.

12. A sheet steel cold forming apparatus comprising a pair of tools for cold rolling sheet steel material having a base gauge, each tool being cylindrical and having an axial dimension extending along an axis of rotation and a circumferential dimension extending orthogonally to the axial dimension, each tool having rows of teeth extending from the circumferential surface, each tooth having a rounded sheet engaging surface and each tooth having;

a rounded peak;

a first radius extending along a first direction;

a second radius extending along the axial dimension;

a third radius extending in a third direction orthogonal to the first direction, said first and third directions extending between said axial and circumferential dimensions, said third radius being equal to a radius of curvature at and adjacent the peak of each tooth, the second radius being the same as the third radius, and the pitch between adjacent teeth in a row being at least three times said radius of curvature, said radius of curvature and pitch providing a balance between maximizing work hardening and minimizing sheet material thinning, the tools being located in close proximity such that teeth on one tool extend into spaces between the teeth of the other tool and the tools being mutually counter-rotatable such that successive teeth on one tool move into and out of alignment with the space between adjacent teeth of the other roll and wherein the rolls are spaced such that each apex of a projection formed on a sheet by action of a tooth of one roll as the sheet passes between the tools is free from contact with the other roll for cold forming sheet steel material.

13. A sheet steel cold forming apparatus according to claim 12, wherein the pitch between adjacent teeth in a row on each tool is least 3.3 times said radius of curvature.

* * * * *